US011148324B2

(12) United States Patent
Xu et al.

(10) Patent No.: US 11,148,324 B2
(45) Date of Patent: Oct. 19, 2021

(54) MANUAL CUTTING MACHINE

(71) Applicant: ROMWAY(ZJ) MACHINERY MANUFACTURING CO., LTD., Shengzhou (CN)

(72) Inventors: Xiaoyu Xu, Shengzhou (CN); Runze Zhu, Shengzhou (CN)

(73) Assignee: ROMWAY (ZJ) MACHINERY MANUFACTURING CO., LTD., Shengzhou (CN)

( * ) Notice: Subject to any disclaimer, the term of this patent is extended or adjusted under 35 U.S.C. 154(b) by 0 days.

(21) Appl. No.: 16/656,825

(22) Filed: Oct. 18, 2019

(65) Prior Publication Data

US 2020/0376711 A1 Dec. 3, 2020

(51) Int. Cl.
*B28D 1/22* (2006.01)
*B28D 7/02* (2006.01)

(52) U.S. Cl.
CPC ..... *B28D 1/223* (2013.01); *B28D 1/225* (2013.01); *B28D 7/02* (2013.01)

(58) Field of Classification Search
CPC ..... B28D 1/225; E04F 21/0076; C03B 33/10; C03B 33/105
USPC ..... 225/96.5
See application file for complete search history.

(56) References Cited

U.S. PATENT DOCUMENTS

| | | | | |
|---|---|---|---|---|
| 5,480,081 | A * | 1/1996 | Wilson | B28D 1/225 125/23.02 |
| 6,148,810 | A * | 11/2000 | Hepworth | B28D 1/225 125/23.01 |
| 2003/0029433 | A1* | 2/2003 | Hepworth | B28D 1/225 125/23.02 |
| 2005/0016518 | A1* | 1/2005 | Ishii | B28D 1/225 125/23.02 |
| 2011/0023859 | A1* | 2/2011 | Torrents I Comas | B28D 1/225 125/23.02 |
| 2018/0290335 | A1* | 10/2018 | Rosello Gargallo | B28D 1/225 |
| 2019/0193300 | A1* | 6/2019 | Sarmiento | B28D 1/225 |
| 2019/0262918 | A1* | 8/2019 | DeSantis | B26B 29/06 |

* cited by examiner

*Primary Examiner* — Kenneth E Peterson
(74) *Attorney, Agent, or Firm* — Jiwen Chen; Jacobson Holman PLLC

(57) ABSTRACT

A manual cutting machine includes a base plate. A front support and a rear support are fixedly arranged at two ends of the base plate. Sliding rods are mounted between the front support and the rear support. A slider is disposed around the sliding rods. A connecting block is hinged to the slider. A blade and a presser foot are connected to the bottom of the connecting rod. A push rod is connected to the top of the connecting block. The tail of the push rod is angled relative to the push rod. When the manual cutting machine is used for cutting and fracturing a board, motions of arms are reduced, and the motion range of an operator is narrowed, so that the operator can use the machine more easily and effortlessly. Meanwhile, oil can be added into an oil can to lubricate the slider in the using process.

9 Claims, 4 Drawing Sheets

MANUAL CUTTING MACHINE

This application claims the priority benefit of Chinese Application No. 2019208275886, filed Jun. 3, 2019, which is hereby incorporated by reference.

BACKGROUND OF THE INVENTION

Technical Field

The present invention belongs to the technical field of cutting machines, in particular to a manual cutting machine.

Description of Related Art

Presently, cutting machines on the market generally include electric cutting machines and manual cutting machines. The electric cutting machines which cut boards such as floor tiles by means of high-speed rotation of the grinding wheels have a good cutting effect, will rarely cause breakage, and can keep cut faces uniform. However, such cutting machines are inconvenient to operate and are dangerous to a certain extent due to the high-speed rotation of the grinding wheel. The manual cutting machines which cut boards such as floor tiles through blades are simple, practical, safe and reliable. Chinese Utility Model Patent Application No. 89216766.1 discloses a manual tile cutting machine which mainly includes a blade holder, a blade, a base plate, and a screw, wherein a ruler, a front support, and a rear support are fixed to the base plate, the front support and the rear support are connected through a guide rod, a slider is arranged on the guide rod, the blade holder is fixed in the slider, the blade is fixed in the blade holder, a control lever is fixed in the slider and controls the slider to slide on the guide rod, and a rubber plate is installed on the base plate. This manual tile cutting machine has the defect that both the hand joints and the shoulder joints of users have to swing drastically in the cutting process, and consequentially, the users may feel uncomfortable. Meanwhile, such manual tile cutting machine is inconvenient to maintain in use and after use.

BRIEF SUMMARY OF THE INVENTION

The object of the present invention is to provide a manual cutting machine which is simple in structure, reasonable in design, capable of being operated by users comfortably, easy to lubricate, and convenient to use.

The following technical solution is adopted by the invention to fulfill the above object:

A manual cutting machine comprises a base plate, a front support and a rear support that are fixedly arranged at two ends of the base plate, and sliding rods that are mounted between the front support and the rear support; characterized in that, a slider is disposed around the sliding rods, a connecting block is hinged to the slider, a blade and a presser foot are connected to the bottom of the connecting block, a push rod is connected to the top of the connecting block, and an angle is formed between the tail of the push rod and the push rod. The push rod pushes the slider to move horizontally on the sliding rods to drive the connecting block and the blade to move, and the blade cuts a board placed on the base plate along the sliding rods. In the present of the angle at the tail of the push rod, users can hold the push rod conveniently.

Furthermore, an oil can or container is connected to the top of the slider in a threaded manner, an oil passage and wool felt are arranged in the slider, the oil passage is communicated with the oil can and the wool felt, and the oil can is provided with a switch used to control the flow of oil in the oil can. When the switch is shifted to one side, oil in the oil can is delivered onto the wool felt via the oil passage, and the sliding rods are lubricated by the wool felt, so that the frictional force between the slider and the sliding rods is reduced, and the connecting block can move on the sliding rods more smoothly. When the switch is shifted to the other side, oil in the oil can is stopped from being delivered onto the wool felt.

Furthermore, the sliding rods include a left cylindrical sliding rod and a right cylindrical sliding rod, a left bearing and a right bearing are arranged in the slider and are respectively disposed around the left cylindrical sliding rod and the right cylindrical sliding rod, and the left bearing and the right bearing are linear bearings. The slider is disposed around the left cylindrical sliding rod and the right cylindrical sliding rod through the left bearing and the right bearing, and the stability of the slider is improved by the two sliding rods. The linear bearings reduce the frictional force between the slider and the sliding rods.

Furthermore, a rubber cushion or a spongy cushion is arranged on the upper surface of the base plate. The board is placed on the rubber cushion or the spongy cushion to be prevented from moving in the cutting process, so that irregular cut faces of the board are avoided.

Furthermore, the angle ranges from 90° to 180° and can reduce the motions or movement of arms.

Furthermore, a handball is arranged at the tail of the push rod. An operator can hold the push rod through the handball, so that the manual cutting machine can be used more comfortably.

Furthermore, a first rotary shaft penetrates through the connecting block and is mounted between two sides of the slider, and the connecting block rotates around the first rotary shaft. The connecting block rotates between the two sides of the slider, so that an operator can rotate the push rod by moving the hand joints to drive the blade and the presser foot to rotate without drastically swinging the shoulder joints.

Furthermore, the sliding rods are positioned and fixed between the front support and the rear support with screws.

Furthermore, a second rotary shaft penetrates through the presser foot and the connecting block, the presser foot rotates around the second rotary shaft and is provided with magnets, the connecting block is provided with an iron sheet which is attracted by the magnets, and a limiting plate is arranged at the bottom of the slider; and the push rod is rotated upwards until the presser foot abuts against or engages the limiting plate, then the magnets are separated from the iron sheet, and the presser foot rotates downwards around the second rotary shaft. When the board is cut, the push rod is horizontally moved, the presser foot is attracted to the iron sheet under the effect of inertia and a magnetic force, and then the board is cut by the blade. When the presser foot is used, the push rod is rotated upwards until the presser foot abuts against the limiting plate, then the magnets are separated from the iron sheet, the presser foot falls down, and the push rod is rotated downwards to fracture the board through the presser foot. The magnets, the iron sheet and the limiting plate are arranged, so that the presser foot can be conveniently used without being touched by hand, and the operator can change the position of the presser foot by moving or rotating the push rod.

Furthermore, an auxiliary presser foot is arranged at the front end of the presser foot, mounting feet are arranged on two sides of the auxiliary presser foot and are clamped to the front end of the presser foot, and the auxiliary presser foot is detachable. Due to the fact that narrow boards such as mosaic tiles cannot be easily fractured by the wide presser foot, the narrow auxiliary presser foot is mounted on the presser foot, and accordingly, the cutting machine can adapt to more boards.

By adoption of the above technical solution, the present invention has the following beneficial effects:

When the manual cutting machine of the present invention is used for cutting and fracturing a board, motions of the arms are reduced, and the motion range of the operator is lowered, so that the operator can use the machine more easily and effortlessly. Meanwhile, oil can be added into the oil can to lubricate the slider in the using process, so that the service life of the manual cutting machine is prolonged, and later maintenance is reduced. The beneficial effects of the invention are particularly as follows:

1. The tail of the push rod is angled relative to the push rod and is provided with the handball, and the operator can hold the handball to rotate the push rod by moving the hand joints without drastically swinging the shoulder joints, so that the comfort in use is improved.

2. The switch is used to control the flow of lubricating oil in the oil can arranged at the top of the slider, the lubricating oil can flow onto the wool felt via the oil passage in the slider, and then the sliding rods are lubricated by the wool felt, so that the frictional force between the slider and the sliding rods is reduced, and the connecting block can move on the sliding rods more smoothly.

3. The slider is disposed around the left cylindrical sliding rod and the right cylindrical sliding rod through the left bearing and the right bearing, so that the stability of the slider on the sliding rods is improved, and the stability of the blade and the presser foot is also improved; and meanwhile, the rubber cushion arranged on the base plate can prevent the board from moving in the cutting process, and thus, irregular cut faces of the board are avoided.

4. Through the configuration of the magnets, the iron sheet and the limiting plate, the presser foot can be used conveniently without being touched by hand, and the operator can change the position of the presser foot by moving or rotating the push rod.

5. The auxiliary presser foot arranged on the presser foot is detachable and is suitable for cutting narrow boards such as mosaic tiles.

BRIEF DESCRIPTION OF THE SEVERAL VIEWS OF THE DRAWINGS

The present invention is further expounded below with reference to the accompanying drawings.

DETAILED DESCRIPTION OF THE INVENTION

Figure 1:
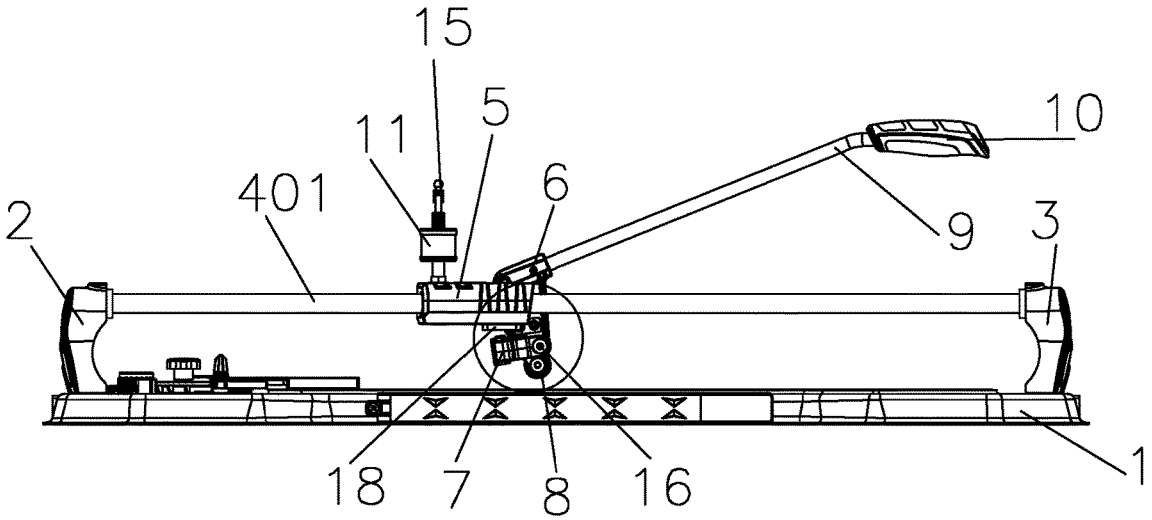
FIG. 1 is a front view of a manual cutting machine of the present invention, wherein the circle showing an area that is shown in enlarged view in FIG. 5.
Figure 2:
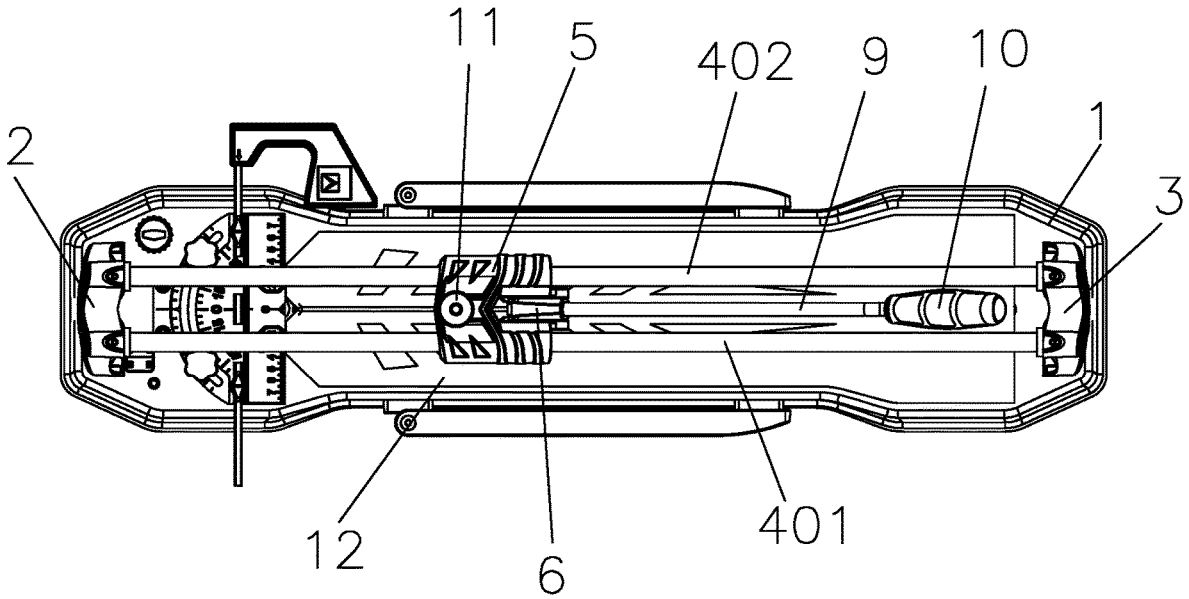
FIG. 2 is a top view of the manual cutting machine in FIG. 1.
Figure 3:
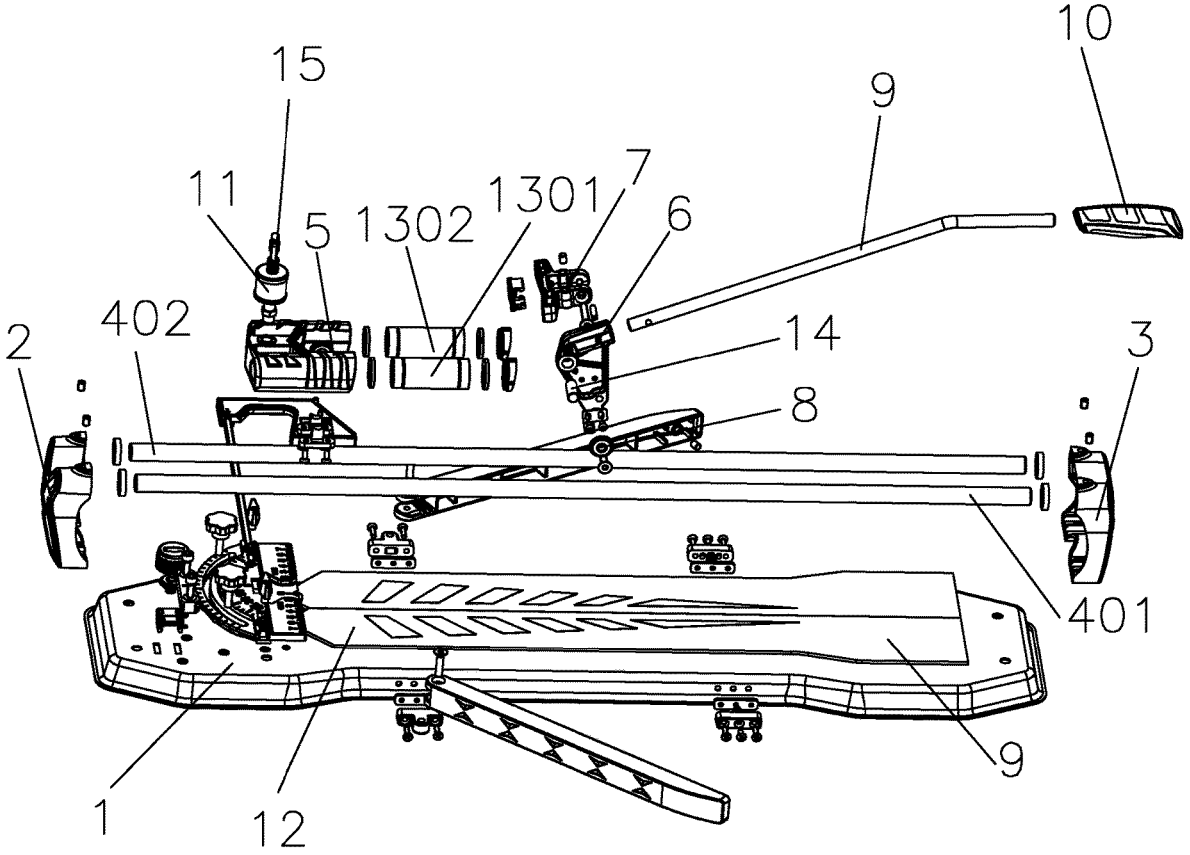
FIG. 3 is an exploded view of the manual cutting machine of the present invention.
Figure 4:
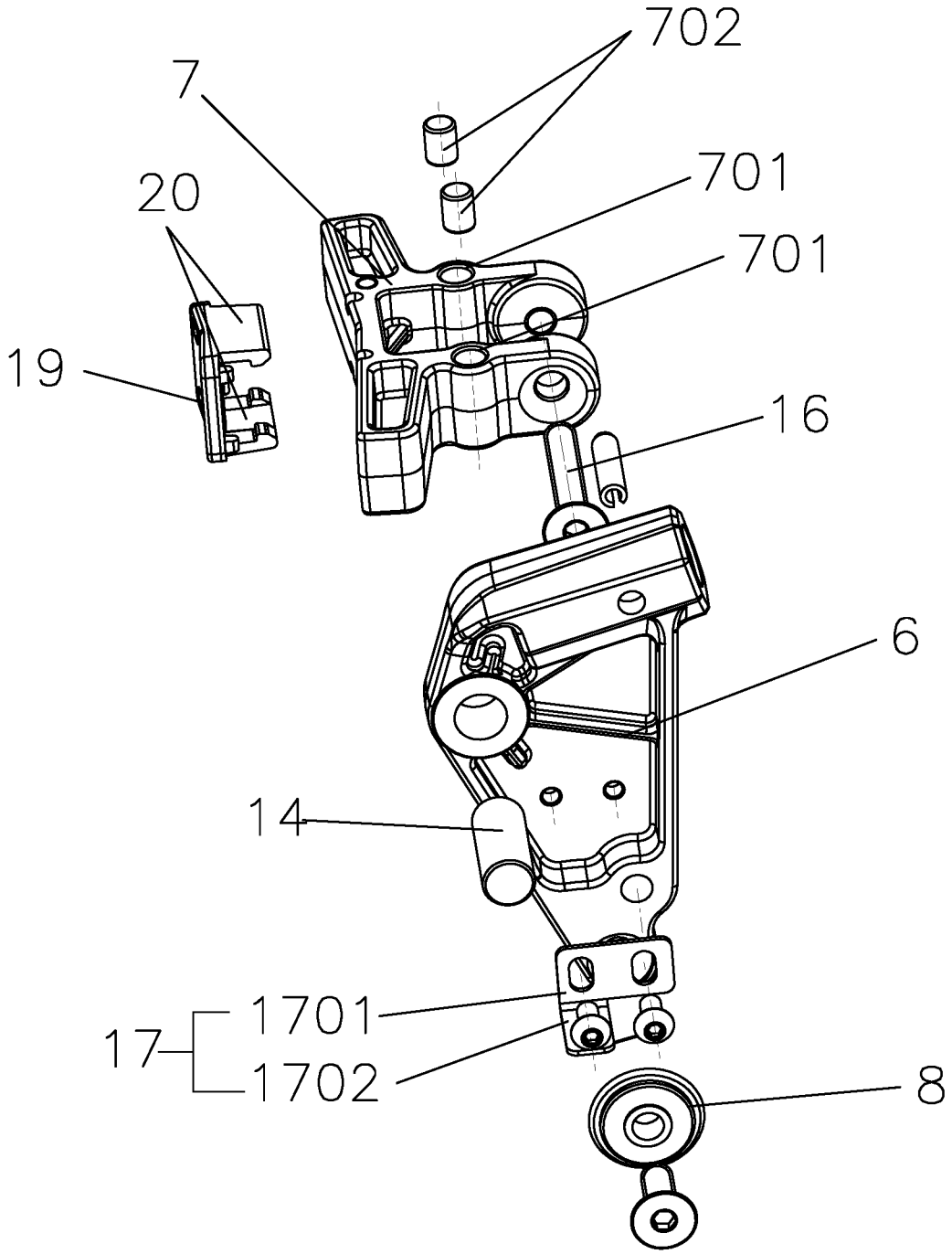
FIG. 4 is an exploded view of a connecting block, a presser foot and a blade of the present invention.
Figure 5:
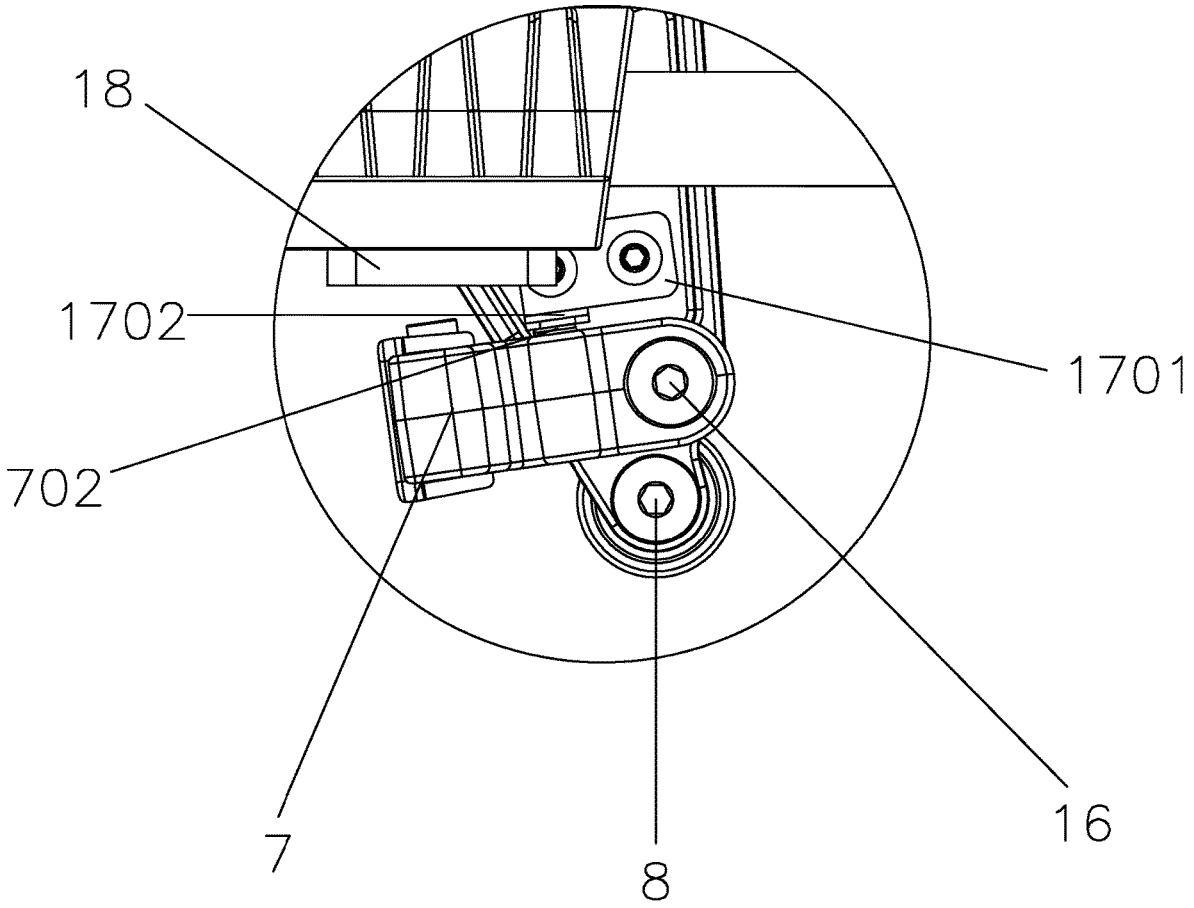
FIG. 5 is an enlarged view of an area shown in FIG. 1.

As shown in FIGS. 1-4, a manual cutting machine comprises a base plate 1. A rubber cushion 12 is arranged on the upper surface of the base plate 1, and a board is placed on the rubber cushion 12 to be prevented from moving in the cutting process, so that irregular cut faces of the board are avoided. A front support 2 and a rear support 3 are fixedly arranged at two ends of the base plate 1. A left cylindrical sliding rod 401 and a right cylindrical sliding rod 402 are mounted between the front support 2 and the rear support 3. A slider 5 is disposed around the left cylindrical sliding rod 401 and the right cylindrical sliding rod 402. A left bearing 1301 and a right bearing 1302 are arranged in the slider 5 and are respectively disposed around the left cylindrical sliding rod 401 and the right cylindrical sliding rod 402. The slider 5 is disposed around the left cylindrical sliding rod 401 and the right cylindrical sliding rod 402 through the left bearing 1301 and the right bearing 1302, and the stability of the slider 5 is improved by the left cylindrical sliding rod 401 and the right cylindrical sliding rod 402. The left bearing 1301 and the right bearing 1302 are both linear bearings, so that the frictional force between the slider 5 and the left and right cylindrical sliding rods 401 and 402 is reduced.

A connecting block 6 is hinged to the slider 5, and a blade 8 and a presser foot 7 are connected to the bottom of the connecting block 6. A push rod 9 is connected to the top of the connecting block 6. A handball 10 is arranged at the tail of the push rod 9, and an angle is formed between the handball and the tail of the push rod 9, ranging from 90° to 180°. The push rod 9 pushes the slider 5 to horizontally move on the left cylindrical sliding rod 401 and the right cylindrical sliding rod 402 so as to drive the connecting block 6, the blade 8 and the presser foot 7 to move, and the blade 8 cuts the board placed on the base plate 1 along the sliding rods. The push rod 9 can be held by an operator by means of the angle and handball 10 at the tail of the push rod 9, so that the manual cutting machine can be used more comfortably. A first rotary shaft 14 penetrates through the connecting block 6 and is mounted between two sides of the slider 5. The connecting block 6 rotates between the two sides of the slider 5, so that the operator can rotate the push rod 9 by moving the hand joints to drive the blade 8 and the presser foot 7 to rotate without drastically swinging the shoulder joints.

A second rotary shaft 16 penetrates through the presser foot 7 and the connecting block 6, and the presser foot 7 rotates around the second rotary shaft 16. Magnet mounting holes 701 are formed in two sides of the presser foot 7, and magnets 702 are mounted in the magnet mounting holes 701. An iron sheet 17 is fixed to the connecting block 6 and comprises an iron sheet mounting plate 1701 and an iron sheet body 1702, wherein the iron sheet mounting plate 1701 is fixed to the connecting block 6 with screws. The push rod 9 is horizontally moved rapidly, and then the presser foot 7 is attracted to the bottom of the iron sheet body 1702 under the effect of inertia and a magnetic force from the magnets 702. A limiting plate 18 is arranged at the bottom of the slider 5. When the push rod 9 drives the connecting block 6 to rotate upwards by a certain angle, the presser foot 7 abuts against the limiting plate 18, then the magnets 702 are separated from the iron sheet body 1702, and the presser foot 7 falls down around the second rotary shaft 16. The push rod 9 can be moved or rotated to change the position of the presser foot 7, so that usage is facilitated. An auxiliary presser foot 19 is arranged at the front end of the presser foot 7, and mounting feet 20 are arranged on two sides of the auxiliary presser foot 19. When the auxiliary presser foot 19 is mounted, the mounting feet 20 are clamped to the front end of the presser foot 7. When the auxiliary presser foot 19 is disassembled, one mounting foot 20 is released. Because the auxiliary presser foot 19 is narrower than the presser foot, the auxiliary presser foot 19 is suitable for narrow boards such as mosaic tiles.

An oil can 11 is connected to the top of the slider 5 in a threaded manner. An oil passage (no shown) is formed in the slider 5. The left bearing 1301 and the right bearing 1302 are provided with wool felt (not shown). The oil passage is communicated with the oil can 11 and the wool felt. A switch 15 is arranged at the top of the oil can 11. When the switch 15 is shifted to one side, oil in the oil can 11 is automatically delivered onto the wool felt via the oil passage, and then the left cylindrical sliding rod 401 and the right cylindrical sliding rod 402 are lubricated by the wool felt, so that the frictional force between the slider 5 and the left and right cylindrical sliding rods 401 and 402 is reduced, and the connecting block 6 can move on the left cylindrical sliding rod 401 and the right cylindrical sliding rod 402 more smoothly. When the switch 15 is shifted to the other side, oil in the oil can 11 is stopped from being delivered onto the wool felt.

During the operation of the manual cutting machine of the present invention, a worker holds the handball 10 by hand to rapidly move the push rod 9, and then the presser foot 7 is attracted to the bottom of the iron sheet body 1702. The push rod 9 is pushed to drive the blade 8 to move to the other end of the board placed on the rubber cushion 12, then the push rod 9 is rotated to drive the connecting block 6 to incline upwards by an angle to align the cutting edge of the blade 8 to the corresponding position of the board, and finally, the blade 8 is forced to move to the other end of the board, so that cutting of the board is completed. After the board is cut, the push rod 9 is rotated upwards to drive the presser foot 7 to abut against the limiting plate 18, and then the presser foot 7 falls down around the second rotary shaft 16. The push rod 9 is rotated downwards to fracture the board through the presser foot 7, so that the board is partitioned.

The above embodiments are only specific ones of the invention, and the technical characteristics of the invention are not limited to these specific embodiments. Any simple variations, equivalent substitutes or modifications achieved based on the invention to settle the same technical issues and to fulfill the same technical effects should also fall within the protection scope of the invention.

What is claimed is:

1. A manual cutting machine, comprising a base plate, wherein a front support and a rear support are fixedly arranged at two ends of the base plate, and sliding rods are mounted between the front support and the rear support; and a slider is disposed around the sliding rods, a connecting block is hinged to the slider, a blade and a presser foot are connected to a bottom of the connecting block, a push rod is connected to a top of the connecting block, and an angle is formed between a tail of the push rod and the push rod;

wherein a second rotary shaft penetrates through the presser foot and the connecting block, the presser foot rotates around the second rotary shaft and is provided with magnets, the connecting block is provided with an iron sheet which is attracted by the magnets, and a limiting plate is arranged at a bottom of the slider, so that when the push rod is rotated upwards away from the base plate until the presser foot abuts against the limiting plate, the magnets are separated from the iron sheet and then the presser foot rotates downward around the second rotary shaft towards the bottom plate.

2. The manual cutting machine according to claim 1, wherein an oil can is connected to a top of the slider in a threaded manner, an oil passage and wool felt are arranged in the slider, the oil passage is communicated with the oil can and the wool felt, and the oil can is provided with a switch.

3. The manual cutting machine according to claim 1, wherein the sliding rods include a left cylindrical sliding rod and a right cylindrical sliding rod, a left bearing and a right bearing are arranged in the slider and are respectively disposed around the left cylindrical sliding rod and the right cylindrical sliding rod, and the left bearing and the right bearing are linear bearings.

4. The manual cutting machine according to claim 1, wherein a rubber cushion or a spongy cushion is arranged on an upper surface of the base plate.

5. The manual cutting machine according to claim 1, wherein the angle ranges from 90° to 180°.

6. The manual cutting machine according to claim 1, wherein a handball is arranged at the tail of the push rod.

7. The manual cutting machine according to claim 1, wherein a first rotary shaft penetrates through the connecting block and is mounted between two sides of the slider, and the connecting block rotates around the first rotary shaft.

8. The manual cutting machine according to claim 1, wherein the sliding rods are positioned and fixed between the front support and the rear support with screws.

9. The manual cutting machine according to claim 1, wherein an auxiliary presser foot is arranged at a front end of the presser foot, mounting feet are arranged on two sides of the auxiliary presser foot and are clamped to the front end of the presser foot, and the auxiliary presser foot is detachable.

* * * * *